US012723204B2

(12) United States Patent
Barletta, Jr. et al.

(10) Patent No.: US 12,723,204 B2
(45) Date of Patent: Sep. 1, 2026

(54) FLUID CATALYTIC CRACKING UNIT FRACTIONATOR

(71) Applicant: PROCESS CONSULTING SERVICES, INC, Houston, TX (US)

(72) Inventors: Anthony Frederick Barletta, Jr., Houston, TX (US); Scott William Golden, Phillips, ME (US); Edward Lee Hartman, Houston, TX (US); Steven Leslie White, Houston, TX (US)

(73) Assignee: PROCESS CONSULTING SERVICES, INC, Houston, TX (US)

( * ) Notice: Subject to any disclaimer, the term of this patent is extended or adjusted under 35 U.S.C. 154(b) by 218 days.

(21) Appl. No.: 18/747,656

(22) Filed: Jun. 19, 2024

(65) Prior Publication Data

US 2026/0049251 A1 Feb. 19, 2026

(51) Int. Cl.
*B01D 3/26* (2006.01)
*C10G 11/18* (2006.01)

(52) U.S. Cl.
CPC ..... *C10G 11/187* (2013.01)

(58) Field of Classification Search
CPC ..... B01D 3/26; C10G 11/18; C10G 11/187
See application file for complete search history.

(56) References Cited

U.S. PATENT DOCUMENTS 2,064,511 A 12/1936 Wells
2,073,446 A 3/1937 Ellsberg
2,874,798 A 2/1959 Walker
2,970,107 A 1/1961 Gilmore
2,973,189 A 2/1961 Chu
4,129,626 A 12/1978 Mellbom
4,579,565 A 4/1986 Heath
4,661,241 A 4/1987 Dabkowski et al.
4,776,948 A 10/1988 Skraba
(Continued)

FOREIGN PATENT DOCUMENTS

WO 2008020053 A3 6/2008

OTHER PUBLICATIONS

D. Laird, Packed FCCU Main Fractionator Upgrades for Performance and Reliability, National Petrochemical & Refiners Association, Annual Meeting paper AM-04-35 (Mar. 21-23, 2004).*
(Continued)

*Primary Examiner* — Randy Boyer
(74) *Attorney, Agent, or Firm* — Patterson + Sheridan, LLP

(57) ABSTRACT

A fluid catalytic cracking unit fractionator including a fractionator column, a bottom liquid section disposed at the bottom of the fractionator column, a slurry pumparound section disposed above the bottom liquid section in the fractionator column, a heavy cycle oil (HCO) pumparound section disposed above the slurry pumparound section, and a pumpdown liquid distributor disposed in the fractionator column between the slurry pumparound section and the HCO pumparound section. The slurry pumparound section including at least one slurry pumparound bed disposed in the fractionator column and at least one slurry pumparound liquid distributor, wherein the at least one slurry pumparound liquid distributor is disposed above the at least one slurry pumparound bed.

19 Claims, 3 Drawing Sheets

(56) References Cited

U.S. PATENT DOCUMENTS

| | | | | |
|---|---|---|---|---|
| 4,776,989 | A | 10/1988 | Harper et al. | |
| 4,782,857 | A | 11/1988 | Bieri | |
| 4,960,443 | A | 10/1990 | Lansford | |
| 5,069,830 | A | 12/1991 | Moore et al. | |
| 5,632,933 | A | 5/1997 | Yeoman et al. | |
| 6,193,849 | B1 | 2/2001 | Lockett, Jr. | |
| 8,888,076 | B2 | 11/2014 | Tamminen et al. | |
| 10,344,219 | B2 | 7/2019 | Niccum et al. | |
| 10,786,751 | B2 * | 9/2020 | Golden | C10G 9/005 |
| 11,034,898 | B2 | 6/2021 | Golden et al. | |
| 11,925,929 | B1 | 3/2024 | Barletta, Jr. et al. | |
| 2010/0018248 | A1 | 1/2010 | Fieler et al. | |
| 2011/0226607 | A1 | 9/2011 | Anderson et al. | |
| 2013/0113128 | A1 | 5/2013 | Alzner et al. | |
| 2013/0256093 | A1 | 10/2013 | Ishiwata et al. | |
| 2014/0171705 | A1 | 6/2014 | Freet et al. | |
| 2014/0183027 | A1 | 7/2014 | Abouelhassan | |
| 2015/0008160 | A1 | 1/2015 | Anderson et al. | |
| 2016/0138863 | A1 | 5/2016 | Urbanski | |

OTHER PUBLICATIONS

D. Hanson and S. H. Lee, Reducing FCC Main Fractionator Operating Risks, Digital Refining PTQ Q1, pp. 19-25 (2021).*

* cited by examiner

FLUID CATALYTIC CRACKING UNIT FRACTIONATOR

BACKGROUND

Field

Embodiments of the present disclosure generally relate to apparatus and method for controlling fluid flow through a slurry pumparound section of a fluid catalytic cracking unit fractionator.

Description of the Related Art

Oil refineries use fluid catalytic cracking units to convert heavy crude oil into lighter products such as liquefied petroleum gas, gasoline, and light cycle oil through a catalytic cracking process. The fluid catalytic cracking unit generally comprises three main vessels: a reactor, a catalyst regenerator, and a fractionator. In the catalytic cracking process, fine catalysts are fluidized and circulated between the reactor and the catalyst regenerator. The reactor contains one or more cyclone separators that separate spent catalyst from hydrocarbon vapors.

The hydrocarbon vapors exit the reactor via a transfer line fluidly coupled with a reactor vapor feed nozzle located near the bottom of the fractionator. The hydrocarbon vapors exit the reactor vapor feed nozzle into a feed zone of the fractionator and flow up through the fractionator. As operators push to increase the amount and rate at which fluid flows through the fractionator, issues such as plugging, flooding, and/or fouling are more frequently encountered within the fractionator, which can significantly reduce throughput and efficiency.

Therefore, there is a need for new and/or improved apparatus and methods for preventing coking in fluid catalytic cracking units.

SUMMARY

In one embodiment, a fluid catalytic cracking unit fractionator including a fractionator column, a bottom liquid section disposed at the bottom of the fractionator column, a slurry pumparound section disposed above the bottom liquid section in the fractionator column, a heavy cycle oil (HCO) pumparound section disposed above the slurry pumparound section, and a pumpdown liquid distributor disposed in the fractionator column between the slurry pumparound section and the HCO pumparound section. The slurry pumparound section including at least one slurry pumparound bed disposed in the fractionator column and at least one slurry pumparound liquid distributor, wherein the at least one slurry pumparound liquid distributor is disposed above the at least one slurry pumparound bed.

In one embodiment, a fluid catalytic cracking unit fractionator, including a fractionator column, a bottom liquid section disposed at a bottom of the fractionator column, a slurry pumparound section, a heavy cycle oil (HCO) pumparound section disposed above the slurry pumparound section, and a pumpdown liquid distributor disposed between the slurry pumparound section and the HCO pumparound section. The slurry pumparound section includes an upper slurry pumparound bed, a lower slurry pumparound bed, an upper slurry pumparound liquid distributor, and a lower slurry pumparound liquid distributor. The bottom liquid section is disposed below the lower slurry pumparound bed. The upper slurry pumparound liquid distributor is disposed above the upper slurry pumparound bed and configured to distribute liquid from the bottom liquid section onto the upper slurry pumparound bed. The lower slurry pumparound liquid distributor disposed below the upper slurry pumparound bed and above the lower slurry pumparound bed and configured to distribute liquid from the bottom liquid section onto the lower slurry pumparound bed.

In one embodiment, a method for preventing coking in a fluid catalytic cracking unit fractionator, including: collecting a liquid in a heavy cycle oil (HCO) pumparound section disposed in a fractionator column of the fluid catalytic cracking unit fractionator; pumping a first portion of the liquid from the HCO pumparound section to a pumpdown spray header, wherein the pumpdown spray header is disposed in the fractionator column and is disposed above a slurry pumparound section; and spraying the first portion of the liquid through the pumpdown spray header onto vapor rising up through the fractionator column, thereby vaporizing at least some of the first portion of the liquid above the slurry pumparound section, wherein the slurry pumparound section is disposed above a bottom liquid section and comprises least one slurry pumparound liquid distributor disposed above at least one slurry pumparound bed.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure generally relates to a fluid catalytic cracking unit fractionator configured for catalytic cracking processes. More specifically, the disclosure describes a slurry pumparound section of a fractionator of the fluid catalytic cracking unit configured to operate at high vapor and liquid loads. The slurry pumparound section comprises an upper bed with an upper liquid distributor (such as an upper spray header or an upper gravity flow distributor), and a lower bed with a lower liquid distributor (such as a lower spray header). It is to be noted that only a portion of the fluid catalytic cracking unit fractionator is illustrated in the figures described herein, and other internal and/or external components may be included.

The embodiments of the slurry pumparound section of the fractionator described herein are configured to operate with a high vapor load, also referred to as c-factor, such as within a range of 0.40-0.50 feet per second (ft/s). C-factor is a term commonly used to quantify vapor loading within different sections of the fractionator.

C-factor may be calculated by the equation:

$$C\text{-factor} = (\text{Vapor } CFS/\text{Cross Sectional Area}) * \sqrt{\{\text{square root}\}}(\text{Vapor Density}/(\text{Liquid Density} - \text{Vapor Density}));$$

where Vapor $CFS$ = Vapor Volumetric Flow Rate in $ft^3$/sec, and where Cross Sectional Area = Area in $ft^2$.

In addition to a high c-factor (i.e., vapor load), the slurry pumparound section is configured to operate with a high liquid flow rate, also referred to as liquid loading, such as within a range of 20-30 gallons per minute/feet squared (gpm/$ft^2$). With the slurry pumparound section configured to operate with a high c-factor and a high liquid load, the embodiments of the fractionator as described herein are configured to operate at a feed rate of unit capacity within a range of 30,000-225,000 barrels per day.

Figure 1:
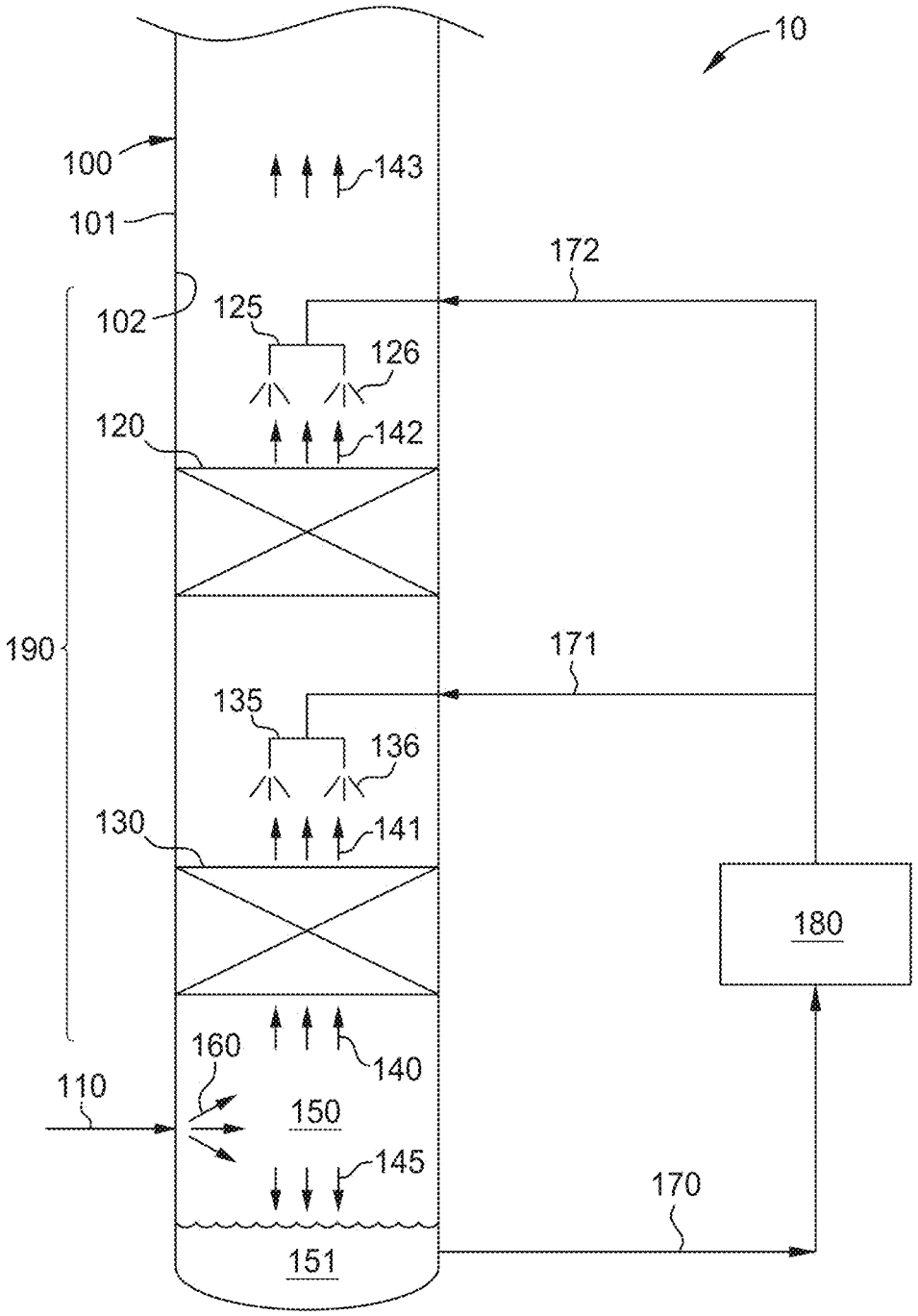
FIG. 1 is a partial schematic side view of a fluid catalytic cracking unit fractionator, according to one embodiment.

FIG. 1 is a partial schematic side view of a fluid catalytic cracking unit fractionator 10, according to one embodiment. The fluid catalytic cracking unit fractionator 10 comprises a fractionator 100 having a fractionator column 101 in the form of a cylindrical vessel. A reactor vapor feed nozzle 110 is coupled to the fractionator column 101 and directs effluent vapor 160, for example hydrocarbon vapor, into the fractionator column 101.

An interior 102 of the fractionator 100 forms multiple zones and sections, one of which is a feed zone 150 into which the effluent vapor 160 is directed via the reactor vapor feed nozzle 110. The velocity in the feed pipe at which the effluent vapor 160 flows into the feed zone 150 may be within a range of 70-150 feet per second (ft/s). Below the feed zone 150 is a bottom liquid section 151 formed at the bottom of the fractionator column 101 where liquid that condenses out of the effluent vapor 160, illustrated by reference arrows 145, can accumulate. The liquid at the bottom of the fractionator column 101 in the bottom liquid section 151 may also be referred to herein as a slurry product. Contaminants such as coke particles may be contained within the slurry product.

A portion of the liquid in the bottom liquid section 151 may be directed to a slurry pumparound section 190 located above the feed zone 150, and sprayed onto the effluent vapor 160 flowing up through the slurry pumparound section 190 (illustrated by reference arrows 140, 141, 142, 143) to cool and lower the temperature of the effluent vapor 160. The slurry pumparound section 190 therefore acts as a cooling or de-superheating zone. The slurry pumparound section 190 is the first pumparound section, e.g. the first section within the fractionator column 101 that contacts the effluent vapor 160. The slurry pumparound section 190 de-superheats the effluent vapor 160 with a portion of the slurry product from the bottom liquid section 151. The portion of the slurry product withdrawn from the fractionator column 101 that is cooled and used to de-superheat the effluent vapor 160 is also referred to as the slurry pumparound. The slurry pumparound section 190 is located directly above the feed zone 150 and is the pumparound section closest to the bottom liquid section 151. As further described below, liquid that has been withdrawn from the bottom liquid section 151 of the fractionator column 101 (i.e. slurry pumparound) is circulated back into the fractionator column 101 via the slurry pumparound section 190.

The temperature of the effluent vapor 160 flowing into the slurry pumparound section 190, illustrated by reference arrows 140, may be within a range of 940-1,030 degrees Fahrenheit. The temperature of the effluent vapor 160 flowing out of the slurry pumparound section 190, illustrated by reference arrows 143, may be within a range of 600-750 degrees Fahrenheit. The c-factor of the effluent vapor 160 flowing from the upper bed 120, illustrated by reference arrows 142, may be within a range of 0.35-0.45 ft/s. The c-factor of the effluent vapor 160 flowing from the lower bed 130, illustrated by reference arrows 141, may be within a range of 0.40-0.50 ft/s.

From the feed zone 150, the effluent vapor 160 begins to rise and flows up into the slurry pumparound section 190, as illustrated by reference arrows 140. The slurry pumparound section 190 comprises an upper bed 120 and a lower bed 130 each disposed in the fractionator column 101. The upper bed 120 and lower bed 130 each comprise grid packing, which comprises multiple layers of stacked, rigid, corrugated, and/or slanted sheets of metal. The grid packing in the upper bed 120 may be within a range of 4-6 feet in height. The grid packing in the lower bed 130 may be within a range of 2-5 feet in height. A height of the grid packing in the upper bed 120 may be greater than a height of the grid packing in the lower bed 130. Commercially available grid packing, such as Flexigrid®, or Proflux®, may be used for the upper bed 120 and lower bed 130.

The slurry pumparound section 190 further comprises an upper liquid distributor 125 disposed above the upper bed 120. The upper liquid distributor 125 may be in the form of an upper spray header or a gravity flow distributor. A gravity flow distributor may be a trough distributor, which consists of narrow boxes called troughs, and one or more parting boxes. Liquid is directed into the one or more parting boxes, which feed the liquid to the troughs, which then direct the liquid onto the upper bed 120 all via gravity distribution. The upper liquid distributor 125 is configured to distribute liquid (from the bottom liquid section 151) onto the upper bed 120. The slurry pumparound section 190 further comprises a lower liquid distributor 135 disposed below the upper bed 120 and above the lower bed 130. The lower liquid distributor 125 may be in the form of a lower spray header. The lower liquid distributor 135 is configured to distribute liquid (from the bottom liquid section 151) onto the lower bed 130. Liquid from the bottom of the upper bed 120 falls onto the lower bed 130.

Liquid from the bottom liquid section 151, located at the bottom of the fractionator column 101, may be directed out of the fractionator column 101 via a fluid line 170 and into a heat exchanger/filter assembly 180. The temperature of the liquid in the bottom liquid section 151 may be within a range of 650-700 degrees Fahrenheit. The portion of the liquid removed from the bottom liquid section 151 (i.e. the slurry pumparound) may be cooled via the heat exchanger/filter assembly to a temperature within a range of 450-600 degrees Fahrenheit. In addition, any solid materials in the slurry pumparound may be removed from the slurry pumparound via the heat exchanger/filter assembly 180. The liquid may then be directed to the upper liquid distributor 125 via an upper fluid line 172 to be distributed, such as sprayed, onto the upper bed 120. The temperature of the liquid distributed from the upper liquid distributor 125 may be within a range of 450-600 degrees Fahrenheit. The liquid may also be directed to the lower liquid distributor 135 via a lower fluid line 171 to be distributed, such as sprayed, onto the lower bed 130. The temperature of the liquid distributed from the lower liquid distributor 135 may be within a range of 450-600 degrees Fahrenheit.

The upper liquid distributor 125 when in the form of a spray header comprises a plurality of upper nozzles 126. The lower liquid distributor 135 when in the form of a spray header comprises a plurality of lower nozzles 136. A liquid loading rate to the upper bed 120 is less than a liquid loading rate to the lower bed 130. For example, a liquid loading rate to the upper bed 120 may be within a range of 10-15 gallons per minute/feet squared (gpm/ft$^2$), and a liquid loading rate to the lower bed may be within a range of 20-30 gpm/ft$^2$. The liquid loading rate to lower bed 130 is greater than the liquid loading rate to the upper bed 120 because liquid from the bottom of the upper bed 120 falls onto the top of the lower bed 130, in addition to the liquid distributed onto the top of the lower bed 130 from the plurality of lower nozzles 136. Any liquid entrained in the effluent vapor 160 flowing up from the lower bed 130 may be washed by the liquid falling down from the upper bed 120.

Figure 2:
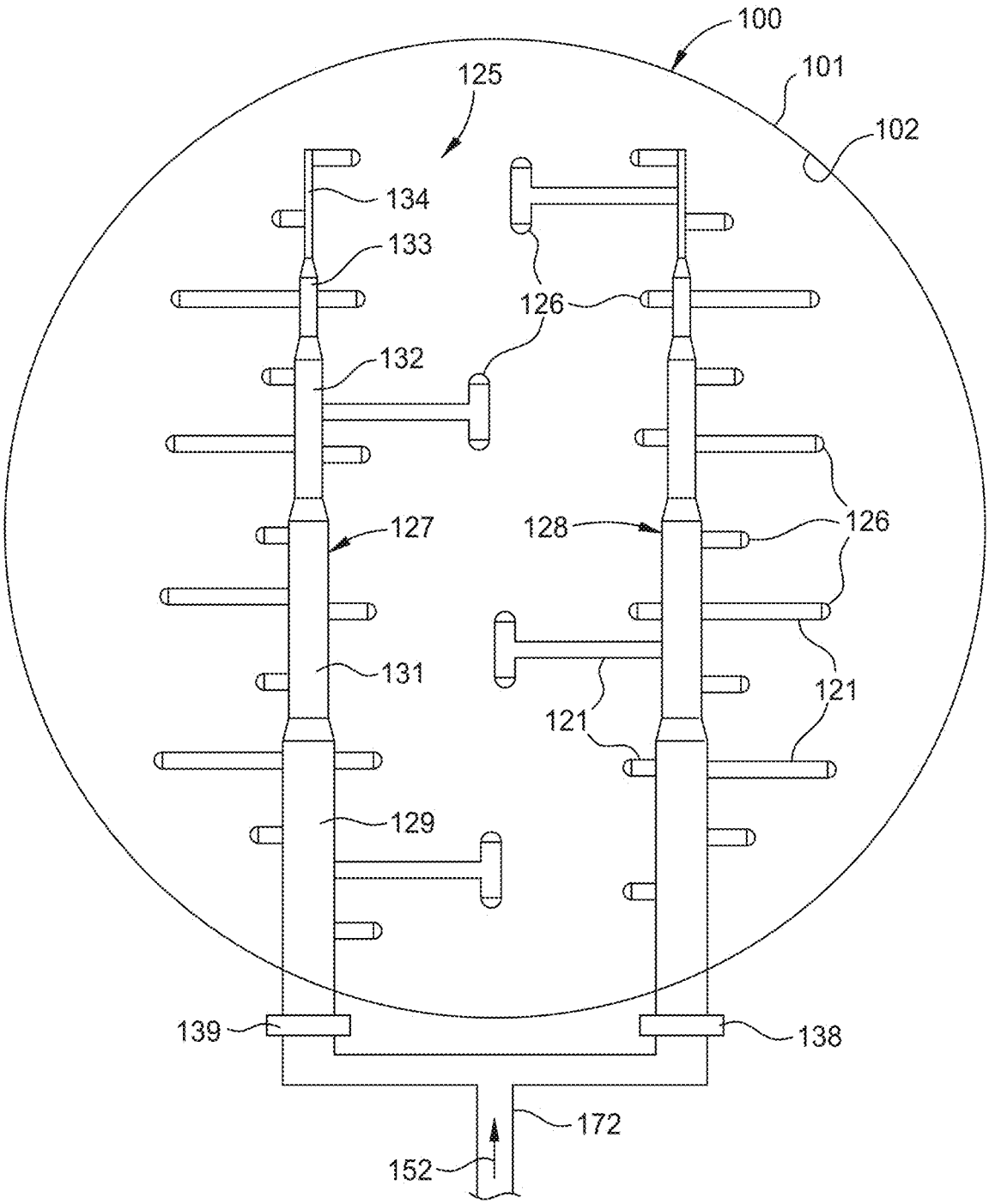
FIG. 2 is a schematic plan view of a spray header of the fluid catalytic cracking unit fractionator, according to one embodiment.

FIG. 2 is a schematic plan view of the upper liquid distributor 125, when in the form of a spray header, of the fractionator 100, according to one embodiment. The description and illustration of the upper spray header 125 in FIG. 2 similarly applies to the lower liquid distributor 135 when in the form of a spray header. Referring to FIG. 2, the upper spray header 125 comprises a first header pipe 127 and a second header pipe 128, each in the form of a tubular member. The first header pipe 127 has an inlet 139 in fluid communication with the upper fluid line 172. The second header pipe 128 has an inlet 138 in fluid communication with the upper fluid line 172. The tubular members forming the first header pipe 127 and second header pipe 128 have variable outer and inner diameters. The reason for the variable diameter is to maintain the velocity of the slurry pumparound 152 in the upper fluid line 172 as the liquid rate in the upper spray header 125 is lowered. Specifically, the diameter of the first header pipe 127 and second header pipe 128 decreases along the length from the end of the first header pipe 127 and second header pipe 128 proximate the inlets 139, 138 to the opposite distal ends.

For example, the first header pipe 127 has a first portion 129 with a diameter greater than the diameter of an adjacent second portion 131. The second portion 131 has a diameter greater than the diameter of an adjacent third portion 132. The third portion 132 has a diameter greater than the diameter of an adjacent fourth portion 133. The fourth portion 133 has a diameter greater than the diameter of an adjacent fifth portion 134. The diameters of the first portion 129, second portion 131, third portion 132, fourth portion 133, and fifth portion 134 may be within a range of 3-16 inches. For example, the first portion 129 may have a diameter of 12 inches, and the fifth portion 134 may have a diameter of 4 inches. The second header pipe 128 has a similar structure as the first header pipe 127.

The first portion 129, second portion 131, third portion 132, fourth portion 133, and fifth portion 134 are in fluid communication with each other and direct fluid (such as liquid from the bottom liquid section 151) to the plurality of upper nozzles 126. The plurality of upper nozzles 126 are located along the length of the first header pipe 127 and second header pipe 128 and are spaced outwardly from the first header pipe 127 and second header pipe 128 via one or more nozzle extensions 121 that are also in the form of tubular members. The nozzle extensions 121 may vary in length. A pair of nozzles 126 may be coupled to one or more nozzle extensions 121.

The lengths, diameters, locations, numbers, orientations, and/or arrangements of the first header pipe 127 and second header pipe 128, the nozzle extensions 121, and/or the plurality of upper nozzles 126 may be adjusted to fit any fractionator column size and/or fractionator operating requirements. The embodiments of the upper spray header 125 and/or lower spray header 135 are not limited to the specific lengths, diameters, locations, numbers, orientations, and/or arrangements of the first header pipe 127 and second header pipe 128, the nozzle extensions 121, and/or the plurality of upper nozzles 126 illustrated in FIG. 2.

The plurality of upper nozzles 126 and lower nozzles 136 are configured to distribute large liquid droplets to minimize entrainment (e.g. liquid trapped within or carried upward by the effluent vapor) within the fractionator column 101. Specifically, when the c-factor of the effluent vapor gets high, e.g. above 0.4 ft/s, liquid droplets can be carried upward with the rising effluent vapor. The smaller the liquid droplet, the easier the liquid droplet is entrained upward with the effluent vapor. Large liquid droplets minimize entrainment because they are heavier. In one example, the plurality of upper nozzles 126 and lower nozzles 136 are configured to distribute droplets of liquid having a diameter greater than 700 microns. The plurality of upper nozzles 126 and lower nozzles 136, 136 are sized to operate in within a pressure drop range of 4-20 psi.

The plurality of upper nozzles 126 and lower nozzles 136 are configured to allow free passage of the liquid to minimize the potential of plugging of one or more of the plurality of upper nozzles 126 and lower nozzles 136. An inner diameter of the plurality of upper nozzles 126 may be the same or greater than an inner diameter of the plurality of lower nozzles 136. For example, the inner diameter of the plurality of upper nozzles 126 is 1 inch or greater, and the inner diameter of the plurality of lower nozzles 136 is 1 inch or greater. A flow rate per nozzle of the plurality of upper nozzles 126 is within a range of 100-160 gpm. A flow rate per nozzle of the plurality of lower nozzles 136 is within a range of 90-130 gpm.

The layouts of the upper spray header 125 and lower spray header 135 may be identical. The plurality of upper nozzles 126 may comprise 38 spray nozzles. For example, the plurality of upper nozzles 126 may comprise any number of spray nozzles within a range of 20-62 spray nozzles. The plurality of lower nozzles 136 may comprise 38 spray nozzles. For example, the plurality of lower nozzles 136 may comprise any number of spray nozzles within a range of 20-62 spray nozzles. The bottom of the plurality of upper nozzles 126 may be within a range of 30-35 inches above the top of the upper bed 120. The bottom of the plurality of lower nozzles 136 may be within a range of 30-35 inches above the top of the lower bed 130.

The liquid rate from the upper spray header 125 to the upper bed 120 may be within a range of 35,000-265,000 barrels per day. Because liquid from the upper bed 120 falls down onto the lower bed 130, the upper bed 120 acts as a demister to enhance the removal of liquid droplets entrained in the effluent vapor 160 flowing up from the lower bed 130. The liquid rate from the lower spray header 135 to the lower bed 130 may be within a range of 25,000-205,000 barrels per day. A portion of the liquid falling from the upper bed 120 toward the lower bed 130 may be vaporized by the effluent vapor 160 before reaching the lower bed 130.

Figure 3:
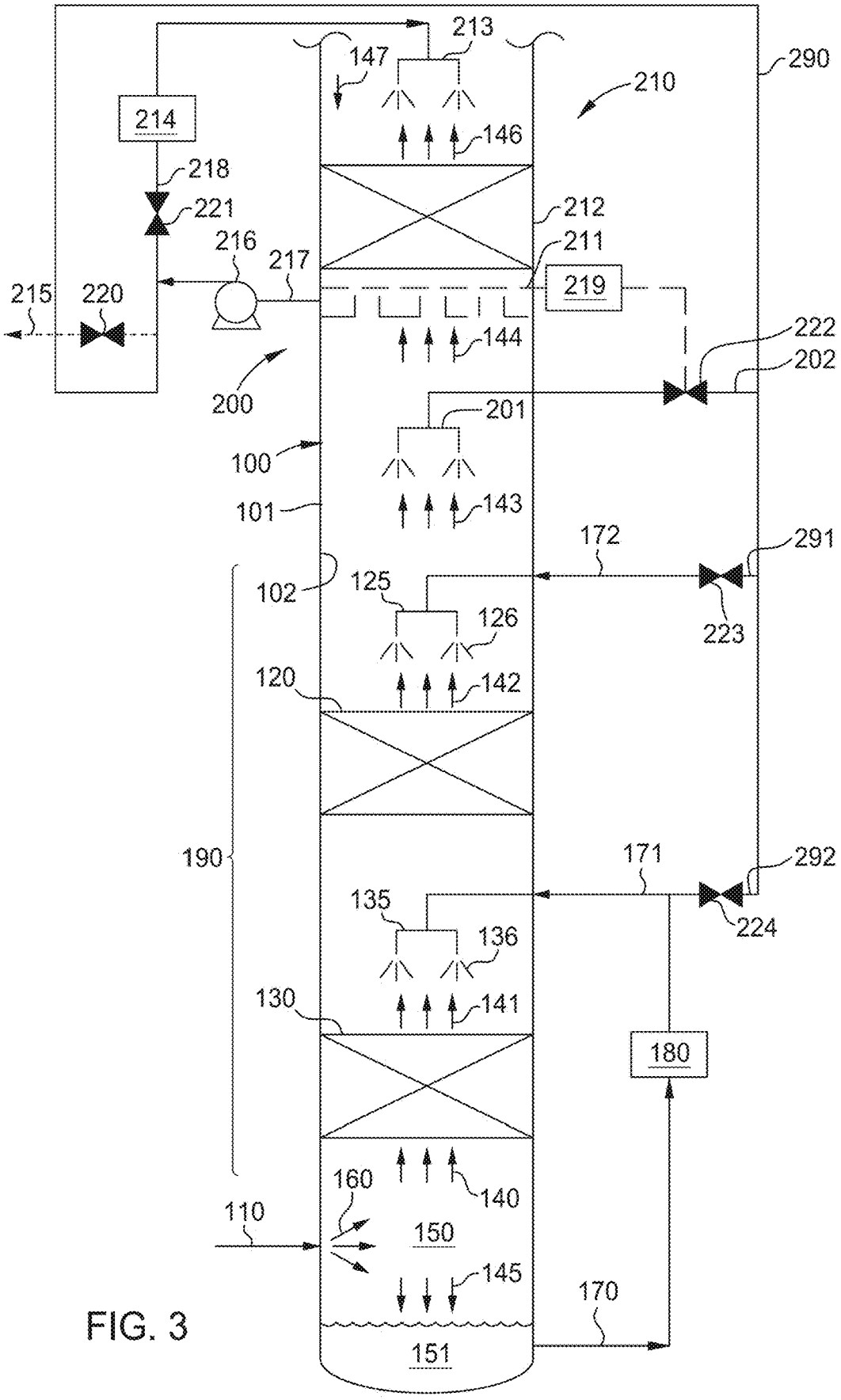
FIG. 3 is a partial schematic side view of another fluid catalytic cracking unit fractionator, according to one embodiment.

FIG. 3 is a partial schematic side view of the fluid catalytic cracking unit fractionator 10, according to one embodiment. The fluid catalytic cracking unit fractionator 10 comprises the fractionator 100 having the fractionator column 101 in the form of a cylindrical vessel. Similar to the embodiments disclosed in FIG. 1, the interior 102 of the fractionator 100 forms multiple zones and sections, such as the feed zone 150 and the slurry pumparound section 190 located above the feed zone 150. The feed zone 150 and the slurry pumparound section 190 have been described above with reference to FIG. 1.

The embodiment of the fluid catalytic cracking unit fractionator 10 shown in FIG. 3 further includes a pumpdown liquid spray zone 200 which distributes pumpdown liquid, and another pumparound section, referred to herein as a heavy cycle oil ("HCO") pumparound section 210 which circulates pumparound liquid and distributes pumpdown liquid. HCO boils between light cycle oil and slurry. HCO can be withdrawn as a separate product from the fractionator column 101. The HCO pumparound section 210 is disposed in the fractionator column 101 above the slurry pumparound section 190. The pumpdown liquid spray zone 200 is disposed in the fractionator column 101 between the HCO pumparound section 210 and the slurry pumparound section 190. The pumpdown liquid distributed to the pumpdown liquid spray zone 200 is sprayed onto the effluent vapor 160 flowing up through the pumpdown liquid spray zone 200, and the pumparound liquid is sprayed onto the effluent vapor 160 flowing up through the HCO pumparound section 210, all to cool and lower the temperature of the effluent vapor 160 (illustrated by reference arrows 143, 144, 146).

The HCO pumparound section 210 includes an HCO collector tray 211, an HCO bed 212, and an HCO liquid distributor 213. The HCO collector tray 211 is disposed at the bottom of the HCO pumparound section 210, above the pumpdown liquid spray zone 200. The HCO bed 212 is disposed above the HCO collector tray 211. The HCO liquid distributor 213 is disposed above the HCO bed 212.

The HCO liquid distributor 213 may be in the form of an upper spray header. The HCO liquid distributor 213 is configured to distribute the pumparound liquid supplied from the HCO collector tray 211 onto the HCO bed 212. In one or more embodiments, the HCO liquid distributor 213 comprises a conventional spray header having one or more rows of spray nozzles. In one or more embodiments, the HCO liquid distributor 213 may be configured in a similar manner as upper liquid distributor 125 as shown in FIG. 2.

The pumparound liquid that is distributed by the HCO liquid distributor 213 comprises a portion of the liquid collected in the HCO collector tray 211. The liquid collected in the HCO collector tray 211 includes condensed effluent vapor 160 that condensed in the HCO bed 212 when in contact with the HCO bed 212. This condensed effluent vapor 160 is referred to herein as first internal reflux. The liquid collected in the HCO collector tray 211 also includes condensed effluent vapor 160 that has condensed above the HCO bed 212 when in contact with trayed or packed sections located above the HCO pumparound. This condensed effluent vapor 160 is referred to herein as second internal reflux 147. Also included in the liquid collected in the HCO collector tray 211 is a fixed and/or predetermined amount of pumparound liquid distributed by the HCO liquid distributor 213 and continuously circulated through the HCO pumparound section 210.

The liquid collected in the HCO collector tray 211 is routed to various locations out of and/or within the fluid catalytic cracking unit fractionator 10. The liquid is routed out of the HCO collector tray 211 via conduit 217 and is pumped via pump 216.

The pump 216 may pump a portion of the collected liquid through a conduit 218 to the HCO liquid distributor 213. This portion of the collected liquid is referred to as "pumparound liquid." In one or more embodiments, the conduit 218 is in communication with a heat exchanger 214, or a network of heat exchangers, to cool the pumparound liquid (e.g. remove heat from the pumparound liquid). The heat exchangers may supply or remove heat to or from one or more locations in the HCO pumparound. The heat exchangers may include for example, debutanizer reboilers and/or feed preheaters. The flow rate of pumparound liquid circulating through the HCO pumparound section 210 via conduit 218 is controlled by a control valve 221. In one or more embodiments with multiple heat exchangers 214, there may be multiple conduits 218 and multiple corresponding control valves 221. In one or more embodiments, the control valves 221 are set to remove a specific amount of heat from the HCO pumparound section 210. The cooled pumparound liquid is distributed onto the HCO bed 212 via the HCO liquid distributor 213 to cool the effluent vapor 160 rising (e.g. flowing up) through the HCO pumparound section 210 and the HCO bed 212, illustrated by reference arrows 144 and 146.

The pump 216 may also, optionally, pump a portion of the collected liquid out of the fluid catalytic cracking unit fractionator 10 via conduit 215 (e.g. an outlet conduit). This portion of the liquid is referred to as "HCO product."

The pump 216 may also pump a portion of the collected liquid through conduit 290. The portion of the collected fluid that is pumped through conduit 290 is referred to as "pumpdown liquid." At least a portion of the pumpdown liquid is pumped to the pumpdown liquid spray zone 200 where it is directed and sprayed from the pumpdown liquid distributor 201 onto the rising effluent vapor 160, illustrated by reference arrows 143. In one or more embodiments, the pumpdown liquid distributor 201 comprises a conventional spray header having one or more rows of spray nozzles. The conventional spray header may have any number of nozzles as determined by the flow rate of the pumpdown liquid and the internal diameter of the column 101. In one or more embodiments, the pumpdown liquid distributor 201 may be configured in a similar manner as the liquid distributor 125 as shown and described in FIG. 2.

A portion of the pumpdown liquid pumped through conduit 290 may also be directed to the slurry pumparound section 190 and distributed to either the upper fluid line 172 to be distributed through the upper liquid distributor 125 and/or the lower fluid line 171 to be distributed through the lower liquid distributor 135. In one or more embodiments, the portion of the pumpdown liquid directed to slurry pumparound section 190 is less than, more than, or equal to the portion directed to the pumpdown liquid spray zone 200.

The HCO collector tray 211 includes a level controller 219 comprising a level sensor. The level controller 219 is configured to detect and determine the amount of liquid collected in the HCO collector tray 211. In one or more embodiments, it is desirable to keep the amount of pumparound liquid being cycled through the HCO pumparound section 210 at or near a constant, fixed, and/or predetermined level and/or volume. The level controller 219 is configured to determine and control the amount of the fluid collected on the HCO collector tray 211 that is pumped to each of the conduits 215, and 290 via one or more control valves.

The conduit 215 includes a control valve 220 to control HCO product flow rate. The control valve 220 may be opened or closed to selectively permit and/or control fluid communication to allow a portion of the fluid collected in the HCO collector tray 211 to be pumped out of the fluid catalytic cracking unit fractionator 10 via the conduit 215 as HCO product or back to the reactor as HCO recycle.

The conduit 202 includes a control valve 222 controlled by the level controller 219. The control valve 222 may be opened or closed to selectively permit the pumpdown liquid from conduit 290 to be pumped to the pumpdown liquid spray zone 200 and/or through the pumpdown liquid distributor 201.

The conduits 291 and 292 may also include control valves 223 and 224 respectively that may be opened or closed to selectively permit the pumpdown liquid to be pumped to the upper fluid line 172 and/or the lower fluid line 171. The control valves 223 and 224 may be configured to control fluid communication between the HCO collector tray 211 and the slurry pumparound section 190.

According to one mode of operation, from the slurry pumparound section 190, the effluent vapor 160 flows up to the pumpdown liquid spray zone 200 (illustrated by reference arrows 143), where the pumpdown liquid distributor 201 directs the pumpdown liquid onto the rising effluent vapor 160. The pumpdown liquid distributor 201 may be spaced a certain distance from the upper liquid distributor 125 forming an empty space within the fractionator column 101. In one or more embodiments, the distance between the pumpdown liquid distributor 201 and the upper liquid distributor 125 is in a range of about 1 foot to about 6 feet.

The rising effluent vapor 160, which is much hotter, partially vaporizes the pumpdown liquid from the pumpdown liquid distributor 201, while the temperature of the rising effluent vapor 160 is reduced prior to flowing up through the HCO pumparound section 210. In one or more embodiments, the distance between the pumpdown liquid distributor 201 and the HCO pumparound section 210 is in a range of about 1 foot to about 6 feet. The addition of the pumpdown liquid spray zone 200 reduces the overall c-factor and vapor load in the slurry pumparound section 190. The c-factor and vapor load are reduced by introducing the pumpdown liquid via the pumpdown liquid distributor 201 in the pumpdown liquid spray zone 200 above the slurry pumparound section 190 so that the introduced pumpdown liquid may re-vaporize and become part of the rising effluent vapor 160 before reaching the slurry pumparound section 190. Thus, the addition of the pumpdown liquid spray zone 200 further has the benefit of increasing slurry pumparound packed bed capacity and lowering the potential for coking.

After passing the pumpdown liquid spray zone 200, the effluent vapor 160, which includes vaporized pumpdown liquid and illustrated by reference arrows 144, rises through the HCO pumparound section 210. The HCO pumparound section 210 removes heat from (e.g. reduces the temperature of) the effluent vapor 160. The effluent vapor 160 rises through the HCO bed 212 and the HCO bed 212 cools the effluent vapor 160 through heat transfer with the pumparound liquid that has been distributed into the HCO pumparound section 210 by the HCO liquid distributor 213.

In the HCO pumparound section 210, pumparound liquid is distributed onto the HCO bed 212 from the HCO liquid distributor 213 to cool the rising effluent vapor 160 (illustrated by reference arrows 144 and 146) through heat transfer. The hotter rising effluent vapor 160 contacts and is cooled by the cooler pumparound liquid from the HCO liquid distributor 213. Similarly, the cooler pumparound liquid contacts and is heated (and/or partially vaporized) by the hotter rising effluent vapor 160. The now heated pumparound liquid is collected in the HCO collector tray 211. The first internal reflux and the second internal reflux 147 as described above are also collected in the HCO collector tray 211.

The collected liquid is then pumped (via pump 216) along the conduit 217. From the conduit 217, portions of the collected liquid may take one of three paths depending on the control valves 220, 221, 222, 223, and 224. A portion of the collected liquid may be output from the system via conduit 215 through control valve 220 as HCO product or HCO recycle. A portion of the collected liquid may be pumped through the heat exchanger 214 from the control valve 221, and to the HCO liquid distributor 213 to be cycled again as pumparound liquid through the HCO pumparound section 210. Finally, a portion of the collected liquid may be pumped as pumpdown liquid through conduit 290. The pumpdown liquid flows through conduit 290 to be distributed to the pumpdown liquid spray zone 200 via the conduit 202 and the control valve 222 or to be distributed in the slurry pumparound section 190 via conduits 291 and/or 292 and the control valves 223 and/or 224, respectively.

Any of the embodiments recited above may be combined, in whole or part, with any of the other embodiments recited above. It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements.

While the foregoing is directed to embodiments of the present disclosure, other and further embodiments of the disclosure may be devised without departing from the basic scope thereof, and the scope thereof is determined by the claims that follow.

We claim:

1. A fluid catalytic cracking unit fractionator, comprising:

a fractionator column;

a bottom liquid section disposed at a bottom of the fractionator column;

a slurry pumparound section disposed above the bottom liquid section in the fractionator column, the slurry pumparound section comprising at least one slurry pumparound bed disposed in the fractionator column and at least one slurry pumparound liquid distributor, wherein the at least one slurry pumparound liquid distributor is disposed above the at least one slurry pumparound bed;

a heavy cycle oil (HCO) pumparound section disposed above the slurry pumparound section; and a pumpdown liquid distributor disposed in the fractionator column between the slurry pumparound section and the HCO pumparound section, wherein the pumpdown liquid distributor is a spray header comprising a plurality of spray nozzles.

2. The fluid catalytic cracking unit fractionator of claim 1, wherein the pumpdown liquid distributor distributes fluid collected in the HCO pumparound section.

3. The fluid catalytic cracking unit fractionator of claim 1, further comprising an outlet conduit, wherein at least a portion of fluid collected in the HCO pumparound section is removed from the fractionator column via the outlet conduit.

4. The fluid catalytic cracking unit fractionator of claim 1, wherein the HCO pumparound section comprises:

a collector tray disposed in the fractionator column;

an HCO bed disposed above the collector tray; and an HCO liquid distributor disposed above the HCO bed.

5. The fluid catalytic cracking unit fractionator of claim 4, wherein the HCO pumparound section further comprises a heat exchanger.

6. The fluid catalytic cracking unit fractionator of claim 5, wherein the heat exchanger is fluidly coupled to the collector tray and the heat exchanger is configured to remove heat from fluid collected in the collector tray before the fluid is routed to the HCO liquid distributor.

7. The fluid catalytic cracking unit fractionator of claim 4, wherein the collector tray is fluidly coupled to the HCO liquid distributor and the HCO liquid distributor distributes fluid collected in the collector tray onto the HCO bed.

8. The fluid catalytic cracking unit fractionator of claim 4, wherein the collector tray is fluidly coupled to the pumpdown liquid distributor and the pumpdown liquid distributor distributes fluid collected by the collector tray.

9. The fluid catalytic cracking unit fractionator of claim 4, wherein the collector tray is fluidly coupled to the slurry pumparound section, and the at least one slurry pumparound liquid distributor distributes fluid collected in the collector tray onto the at least one slurry pumparound bed.

10. The fluid catalytic cracking unit fractionator of claim 9, further comprising one or more control valves configured to control fluid communication between the collector tray and the slurry pumparound section.

11. A fluid catalytic cracking unit fractionator, comprising:

a fractionator column;

a bottom liquid section disposed at a bottom of the fractionator column;

a slurry pumparound section comprising:

an upper slurry pumparound bed and a lower slurry pumparound bed each disposed in the fractionator column, wherein the bottom liquid section is disposed below the lower slurry pumparound bed;

an upper slurry pumparound liquid distributor disposed above the upper slurry pumparound bed and configured to distribute liquid from the bottom liquid section onto the upper slurry pumparound bed; and a lower slurry pumparound liquid distributor disposed below the upper slurry pumparound bed and above the lower slurry pumparound bed and configured to distribute liquid from the bottom liquid section onto the lower slurry pumparound bed;

a heavy cycle oil (HCO) pumparound section disposed above the slurry pumparound section; and a pumpdown liquid distributor disposed between the slurry pumparound section and the HCO pumparound section.

12. The fluid catalytic cracking unit fractionator of claim 11, wherein liquid from the HCO pumparound section is pumped to the pumpdown liquid distributor.

13. The fluid catalytic cracking unit fractionator of claim 11, wherein liquid from the HCO pumparound section is pumped to the slurry pumparound section.

14. The fluid catalytic cracking unit fractionator of claim 13, wherein one or more control valves control liquid flow between the HCO pumparound section and the slurry pumparound section.

15. The fluid catalytic cracking unit fractionator of claim 11, wherein the HCO pumparound section comprises:

at least one collector tray;

at least one HCO bed; and at least one HCO liquid distributor disposed above the HCO bed, wherein the at least one HCO liquid distributor distributes liquid collected in the at least one collector tray onto the at least one HCO bed.

16. The fluid catalytic cracking unit fractionator of claim 15, wherein the HCO pumparound section further comprises at least one heat exchanger.

17. A method for preventing coking in a fluid catalytic cracking unit fractionator, comprising:

collecting a liquid in a heavy cycle oil (HCO) pumparound section disposed in a fractionator column of the fluid catalytic cracking unit fractionator;

pumping a first portion of the liquid from the HCO pumparound section to a pumpdown spray header, wherein the pumpdown spray header is disposed in the fractionator column and is disposed above a slurry pumparound section; and spraying the first portion of the liquid through a plurality of spray nozzles of the pumpdown spray header onto vapor rising up through the fractionator column, thereby vaporizing at least some of the first portion of the liquid above the slurry pumparound section, wherein the slurry pumparound section is disposed above a bottom liquid section and comprises at least one slurry pumparound liquid distributor disposed above at least one slurry pumparound bed.

18. The method of claim 17, wherein:

the liquid is collected in an HCO collector tray of the HCO pumparound section; and the method further comprising:

pumping a second portion of the liquid from the HCO collector tray to an HCO liquid distributor disposed above an HCO bed, wherein the HCO liquid distributor and the HCO bed are disposed in the HCO pumparound section; and pumping a third portion of the liquid from the HCO collector tray to the at least one slurry pumparound liquid distributor.

19. The method of claim 18 further comprising:

determining a volume of the liquid with a level controller of the HCO collector tray; and maintaining the volume of the liquid at a predetermined amount.

* * * * *